US009677361B2

(12) United States Patent
Patterson

(10) Patent No.: US 9,677,361 B2
(45) Date of Patent: Jun. 13, 2017

(54) DRILL PIPE SCREENS

(71) Applicant: James Patterson, Bakersfield, CA (US)

(72) Inventor: James Patterson, Bakersfield, CA (US)

( * ) Notice: Subject to any disclaimer, the term of this patent is extended or adjusted under 35 U.S.C. 154(b) by 322 days.

(21) Appl. No.: 14/223,902

(22) Filed: Mar. 24, 2014

(65) Prior Publication Data

US 2015/0267511 A1 Sep. 24, 2015

(51) Int. Cl.
*E21B 27/00* (2006.01)
*E21B 12/00* (2006.01)
*E21B 21/00* (2006.01)

(52) U.S. Cl.
CPC ..... *E21B 27/005* (2013.01); *E21B 12/00* (2013.01); *E21B 21/002* (2013.01)

(58) Field of Classification Search
CPC ..... E21B 27/005; E21B 27/00
See application file for complete search history.

(56) References Cited

U.S. PATENT DOCUMENTS 921,337 A 5/1909 Archer
1,207,808 A 12/1916 Steps
1,665,569 A * 4/1928 Von Gunten ..... E21B 7/20 166/157
2,969,840 A * 1/1961 D'Audiffret ..... E21B 43/086 138/141
2,985,241 A 5/1961 Hanslip
3,930,538 A 1/1976 Brennan et al.
4,182,414 A 1/1980 Sanders et al.
5,551,513 A * 9/1996 Surles ..... E21B 43/082 166/205
6,390,192 B2 5/2002 Doesburg et al.
6,749,024 B2 6/2004 Bixenman
6,904,974 B2 * 6/2005 Slack ..... E21B 43/086 166/207
7,069,657 B2 7/2006 Culp et al.
7,096,939 B2 8/2006 Kirk et al.
(Continued)

FOREIGN PATENT DOCUMENTS

CN 201053309 6/2006
GB 2416551 2/2006

OTHER PUBLICATIONS

Dictionary definition of "diameter", accessed on Mar. 28, 2016 via www.thefreedictionary.com.*
(Continued)

*Primary Examiner* — Blake Michener
*Assistant Examiner* — Manuel C Portocarrero
(74) *Attorney, Agent, or Firm* — Mark D. Miller; William K. Nelson

(57) ABSTRACT

The present invention includes drill pipe screens and related methods that provide reliable long-term filtering of drilling fluids used to operate alternator turbines that are used to provide power in measurement while drilling (MWD) systems without allowing debris to pass through the screens to the turbines, and without causing intermittent pressure spikes at times when the screens are not completely clogged while maintaining desired circulation rates of drilling fluids. Embodiments of the invention include cylindrical bodies having alternating sets of elongated slots and peripheral ports located thereon to provide filtering of and relief to drilling fluids under pressure.

1 Claim, 8 Drawing Sheets

(56) References Cited

U.S. PATENT DOCUMENTS

| | | | | |
|---|---|---|---|---|
| 7,188,687 | B2 * | 3/2007 | Rudd | B21D 17/04 166/207 |
| 7,950,458 | B2 * | 5/2011 | Livingstone | E21B 21/12 166/302 |
| 8,302,676 | B2 | 11/2012 | Livingstone | |
| 8,430,158 | B2 | 4/2013 | Holderman et al. | |
| 2001/0003313 | A1 | 6/2001 | Doesburg et al. | |
| 2003/0062170 | A1 * | 4/2003 | Slack | E21B 43/086 166/377 |
| 2003/0089495 | A1 | 5/2003 | Bixenman | |
| 2003/0150616 | A1 * | 8/2003 | Mashburn | E21B 27/005 166/311 |
| 2005/0121232 | A1 | 6/2005 | Rudd et al. | |
| 2005/0150654 | A1 | 7/2005 | Kirk et al. | |
| 2005/0204528 | A1 | 9/2005 | Culp et al. | |
| 2008/0236809 | A1 | 10/2008 | Livingstone | |
| 2011/0192604 | A1 | 8/2011 | Livingstone | |
| 2012/0048536 | A1 | 3/2012 | Holderman et al. | |
| 2013/0105145 | A1 | 5/2013 | Gupta et al. | |
| 2014/0116681 | A1 * | 5/2014 | Broussard | E21B 27/005 166/227 |

OTHER PUBLICATIONS

Schlumberger Oilfied Glossary entry for "Kelly", accessed on Mar. 28, 2016 via www.glossary.oilfield.slb.com.*

Alloy Manufacturing, Inc. web site (http://www.alloymanufacturing.com/drill-pipe-mud-screens), Mar. 24, 2014.

Hunting web site (http://www.hunting-intl.com/hunting-specialty-supply/drill-pipe-screens), Jan. 12, 2014.

Hunting web site (http://hunting-intl.com/hunting-specialty-supply/downhole-filter-sub-rentals), Feb. 24, 2014.

Hunting web site (http://mwd-tools.com/mwd-components/drill-pipe-screens), Mar. 24, 2014.

Mashburn web site, surface drill pipe screens (http://mashburnmachine.com), Mar. 21, 2104.

Mashburn web site, Downhole filter screens (http://mashburnmachine.com), Mar. 21, 2104.

Mason web site (http://masonspecialtytools.co/drilling-tools.html), Jan. 13, 2014.

Mason Specialty Tools (brochure), Jan. 13, 2014.

Pacific MWD, Inc. web site (http://www.pacificmwd.com/products/Pipe-Screen), Mar. 24, 2014.

SMS Precision Tech web site (http://www.smsprecisiontech.com/drill-pipe-screens), Mar. 24, 2014.

* cited by examiner

DRILL PIPE SCREENS

BACKGROUND OF THE INVENTION

1. Field of Invention

The present invention relates to equipment utilized during measurement while drilling (MWD) data retrieval in subterranean wells. In particular, the invention relates to filtering apparatus and related methods for preventing debris from entering sensitive areas in a drilling system such as a turbine power source used to operate directional sensors, while maintaining desired flow rates for optimal drilling.

2. Description of the Related Art

Horizontal (directional) drilling continues to prove to be an extremely efficient method for retrieving oil. Conventional vertical wells are limited by surface land formations limiting possible rig set up, and subterranean oil formations that are extremely difficult to extrapolate through conventional methods for maximum oil production. Horizontal drilling offers a solution to many complications currently faced through conventional vertical wells. Some of the most important pieces of equipment required in horizontal drilling are directional sensors located at the distal end of a drill string that transmit vital survey, formation, and performance data to the surface without requiring costly down time. The directional sensors require local power which is commonly provided by turbine alternators which are located near the directional sensors in the drill string. The turbine alternators are operated by circulating drilling mud through the drill string and into a turbine causing the turbine to spin thereby generating electricity to power the directional sensors. Turbine alternators are preferred over alternative battery power sources because they generally offer a more effective power source with a longer operating life.

It is well known that the turbines within such alternators are highly sensitive. If a turbine is damaged, a power failure may occur resulting in loss of electricity to the directional sensors. This can bring horizontal drilling operations to a halt until the turbines are repaired or replaced, which can be a very expensive and time consuming process since it requires removal of the entire drill string from the well, repair/replacement of the turbine alternators, and reinsertion of the drill string into the well. It is therefore important to avoid such extended down time.

In order to protect the turbines and limit potential power failures to the directional sensors, a MWD drill pipe screen or mud screen is ordinarily placed at the top of the drill string to control debris from entering the drill string and finding its way to the vital turbine alternators. It is to be appreciated that when such a screen or filter becomes clogged, there is usually an associated spike in the pressure of the drilling mud used to operate the turbines. When such a spike is noticed, it is a signal to the drilling operators to change the screen, or risk damage to the drill string from buildup of excessive pressure. Replacing the drill pipe screen is a cumbersome process, requiring drilling operations to be shut down while the filter is removed, cleaned and/or replaced, but this preferable to a blowout from excessive pressure, or causing damage to the turbines at the other end of the drill string.

Existing drill pipe screens include spiral drill pipe screens, bar/rod drill pipe screens, slotted tube drill pipe screens, and perforated drill pipe screens. However, each of these types of drill pipe screen suffers from one or more disadvantages. For example and without limitation, existing drill pipe screens (particularly spiral and slotted tube screens) tend to clog readily, and may cause a spike in drilling mud pressure after a relatively short period of time (e.g., 2-3 runs). In addition, existing drill pipe screens may cause small pressure spikes even though the screen may not be completely clogged, forcing the drilling operators to stop operations to check the status of the screen only to find that it is not significantly clogged and operations could have continued. This results in unnecessary downtime to check and thereafter clean or replace a drill pipe screen that did not actually need to be serviced. Current screens also suffer extensive failures due to damage sustained to the base metal of the screen (particularly bar-rod and perforated screens) allowing debris to pass through the screen and reach the sensitive turbine, potentially causing serious damage and drilling down time, and loss of drilling mud circulation which affects all drilling processes.

The oil and gas industry continues to streamline drilling processes with a keen eye on safety and cost management. However, as vital as drill pipe screens are to horizontal drilling, screen designs have not changed in the industry for an extended length of time. As horizontal drilling proves to be an effective method of drilling, a need has arisen for improved MWD drill pipe screens and related methods that maximize necessary drilling mud circulation, that are strong and reliable in order to provide substantial debris filtration, and that perform for extended periods of time without removal, repair or replacement in order to maximize efficiency and reduce costs.

SUMMARY OF THE INVENTION

The present invention addresses these needs by providing drill pipe screens and related methods that provide reliable long-term filtering of drilling mud in MWD systems without allowing debris to pass through the screens and without causing intermittent pressure spikes at times when the screens are not completely clogged, while maintaining desired circulation rates of drilling fluids. Embodiments of the present invention accomplish such functionality through the use of unitary hollow cylindrical bodies having an alternating pattern of elongated parallel peripheral slots and small peripheral relief ports along the length of such bodies in which the primary filtering is provided through the elongated peripheral slots, and intermittent pressure spikes are avoided because of the peripheral relief ports.

In embodiments of the invention, a single cylindrical piece of hollow metal is provided, preferably in the form of a tube of iron, stainless steel or the like, although other durable metals may also be used. For example and without limitation, 1018 mild steel, 4140 steel, 4142 steel, 4145 steel or a stainless steel alloy may be used. An alternating pattern comprising a set of elongated parallel peripheral slots followed by a set of small peripheral relief ports are provided along the length of such tubes. Each set of parallel peripheral slots are provided in the wall of the tube aligned in parallel with the axial center of the tube, through which drilling mud will be passed from inside the tube to outside the tube. The lengths and widths of such slots are preferably the same for each slot in the set, and may be varied according to the strength of the metal material of the tube. The slots are preferably evenly spaced apart and radially positioned around the perimeter of the tube, and are sized in order to provide sufficient strength to avoid breakage of the portions of the tube between the slots from debris in the drilling mud caught inside the tube as mud flows outward from the inside of the tube through the slots, while at the same time providing sufficiently large openings for good flow of drilling mud through the slots themselves.

In embodiments of the invention, a separate set of smaller peripheral relief ports is provided adjacent to each set of peripheral slots. The relief ports are also preferably evenly spaced apart, and are also radially positioned around the perimeter of the tube. The relief ports are preferably provided in the form of small circular openings, although different symmetrically shaped openings may also be used (hexagonal, octagonal, oval, square, rectangular, etc.). It is to be appreciated that a portion of the tube is present between each set of relief ports and the adjacent set of slots, forming cylindrical bands between slots and ports. Such bands provide peripheral strength to the tube, and the slots and ports are positioned in order that such bands are sufficiently large and strong enough to avoid breakage in the material of the tube adjacent to the slots from debris in the drilling mud caught inside the tube as mud flows through the slots and relief ports.

By way of example and without limitation, a typical embodiment of a screening tube of the present invention may include a first set of peripheral ports at one end (e.g., the bottom) of a hollow metallic tube, followed by a first set of elongated slots along the length of the tube, followed by a second set of peripheral ports, followed by a second set of elongated slots along the length of the tube, followed by a third set of peripheral ports, followed by a third and final set of elongated slots along the length of the tube reaching the opposite end (e.g., the top) of the tube, it being understood that the positioning of the slots and ports also define sets of circumferential bands of tube material between each set of slots and each set of ports. In most embodiments, the same number of slots and ports are provided in each set (e.g. 16 slots and 16 ports), although different numbers of each may also be provided (e.g. 15 slots and 17 ports); and, in most embodiments the slots and ports are ordinarily in axial alignment with each other along the length of the tube, although they may be provided in different patterns as well, such as offset, helical, etc. In most embodiments, a first set of relief ports is provided at the lowermost end of the tube, although in other embodiments a first set of slots may be the lowest item provided on the tube.

A lower cap is designed to be welded or otherwise permanently attached to the bottom end of a tube of the present invention, the lower cap having a plurality of holes therein. An upper cap is also designed to be welded or otherwise attached to the opposite upper end of such a tube for engagement within the drill string A key to the design of embodiments of the present invention is that wide peripheral integrity bands must be provided in the tube between sets of slots, and these bands must have sufficient length in order to provide sufficient strength to avoid breakage of the tube, but that the relief ports are also necessary in the integrity bands because without the relief ports, the presence of long peripheral bands could cause undesired pressure spikes as the tube fills with debris during screening operations. In particular, as mud is filtered through an embodiment of the present invention, the lowermost set of slots will be the first to slowly become clogged with debris. At the point in time when such a lowermost set of slots becomes completely clogged, it is to be appreciated that escaping mud must now flow through the remaining unclogged upper slots and relief ports. At this same point in time, the mud flowing through the tube encounters the lowermost peripheral band of the tube, where flow is interrupted and debris begins to readily accumulate. The encounter of this interruption in flow could cause a spike in fluid pressure if the integrity band were too long, but the presence of the relief ports in the integrity band allows the flow of mud to continue, thereby stabilizing the pressure of the flowing mud so that no significant spike is encountered.

In preferred embodiments, the openings for the slots and/or ports are the same size on the inside of the tube and on the outside of the tube. Of course, as shown in FIG. 3, since the tube is generally cylindrical in shape, the material of the tube wall itself between the openings in these embodiments will be smaller in size (e.g., surface width) on the inside of the tube than on the outside of the tube. Thus, in preferred embodiments, the material of the tube wall between adjacent slots and/or ports exhibits a taper, so that the width of the inside surface of the tube wall between particular adjacent slots or ports of the tube is smaller than the width of the outside surface of the tube wall between the same adjacent slots or ports of the tube.

However, in other embodiments the openings for the slots and/or ports may be tapered so that the opening for a particular slot or port on the outside of the tube may be wider than the opening for that same slot or port on the inside of the tube. In further embodiments, the slots and/or ports may be oppositely tapered so that the openings for a particular slot or port on the inside of the tube may be wider than the opening for that same slot or port on the outside of the tube.

In different exemplary embodiments, and without limitation, the preferred lengths of the cylindrical tubing may range from about 16 inches to about 48 inches, preferred outside diameters of the tubing may range from about 1 and ⅜ inches to about 3 and ⅛ inches, and preferred inside diameters of the tubing may range from about ⅞ inches to about 2 and ⅞ inches. In different exemplary embodiments, and without limitation, the preferred number of slots in each set may range from 10 to 20 , and the preferred number of peripheral ports in each set may range from 10 to 20 with a potential total of as few as 20 to as many as 120 slots or holes in an entire exemplary screen unit. In different exemplary embodiments, and without limitation, preferred widths of the slots and holes may range from about ⅛ inch to about ½ inch, preferably about ¼ inch, and preferred lengths of the slots may range from about 4 inches to about 8 inches, preferably about 6 and ¾ inches. In different exemplary embodiments, and without limitation, preferred lengths of the integrity bands between adjacent sets of slots along the tube may range from about ¾ inch to about 2 and ¼ inches, preferably about 1 and ¼ inches, it being understood that the relief ports are provided in the middle of the integrity bands. It is to be appreciated that the above ranges are exemplary, and that measurements outside of these ranges are also within the scope of the present invention. It is also to be appreciated that embodiments of the present invention may include a wide variety of different combinations of different tubing sizes, lengths, widths and diameters, as well as a wide variety of different combinations of slot numbers, sizes, lengths and widths and different relief port numbers, sizes, lengths and widths.

In an exemplary preferred embodiment (illustrated in the drawings), three sets of sixteen (16) slots and three sets of sixteen (16) relief ports are provided; the walls of the exemplary tube have a sectional width of ¼ inch, an inside diameter of 2 and ⅜ inch and an outside diameter of 2 and ⅞ inch. (See, e.g., FIG. 3.)

It is therefore an important object of the present invention to provide mud screens for use in MWD drilling systems that operate for long periods of time without causing intermittent pressure spikes at times when the screens are not completely clogged.

It is also an important object of the present invention to provide reliable mud screens for use in MWD drilling systems that are durable, resist breakage and prevent debris from passing through the screens.

It is also an important object of the present invention to provide mud screens for use in MWD drilling systems that maintain desired circulation rates of drilling fluids.

Additional objects of the invention will be apparent from the detailed description and the claims herein.

BRIEF DESCRIPTIONS OF THE DRAWINGS

DETAILED DESCRIPTION

Figure 2:
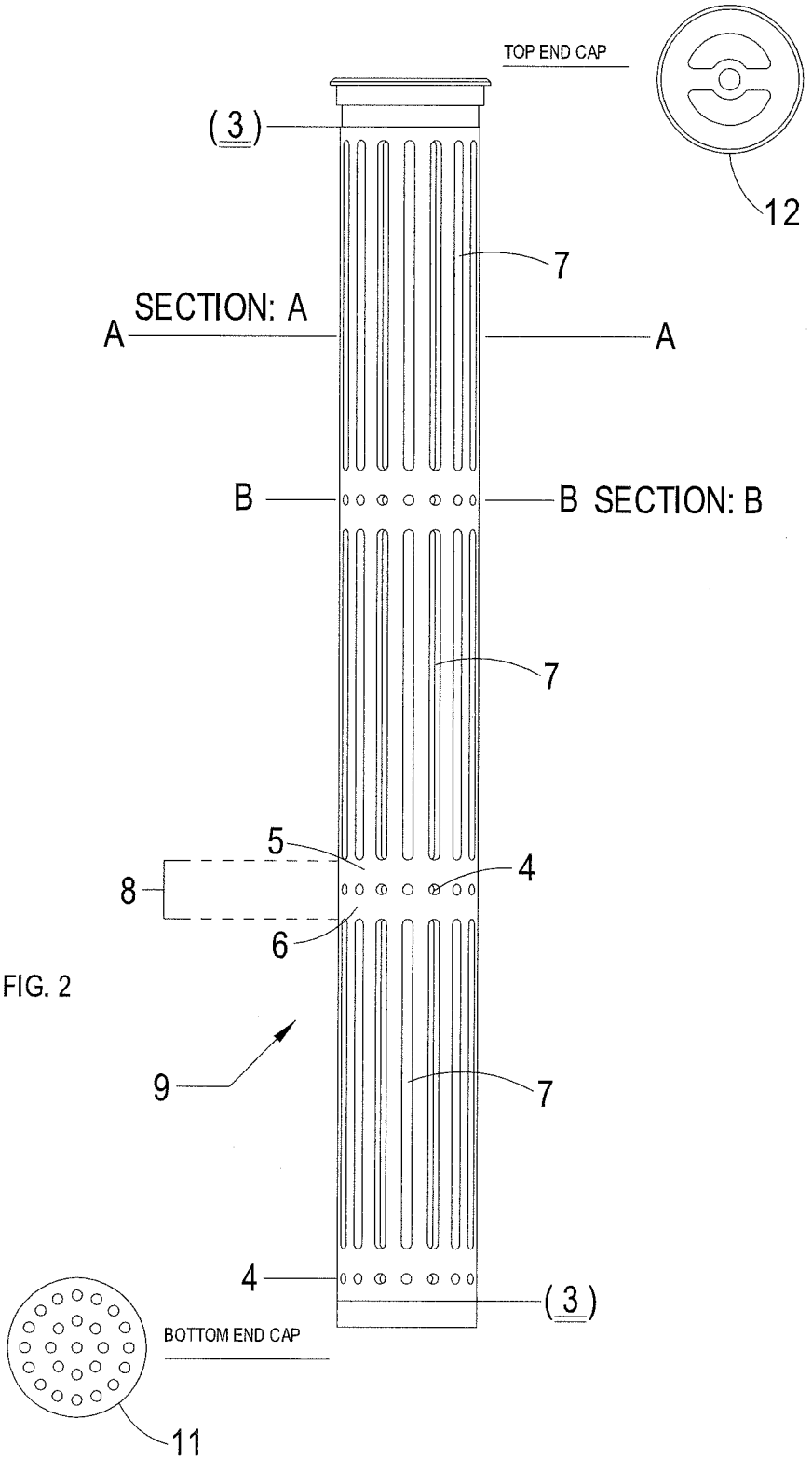
FIG. 2 is a side elevational view of an embodiment of the present invention.
Figure 5:
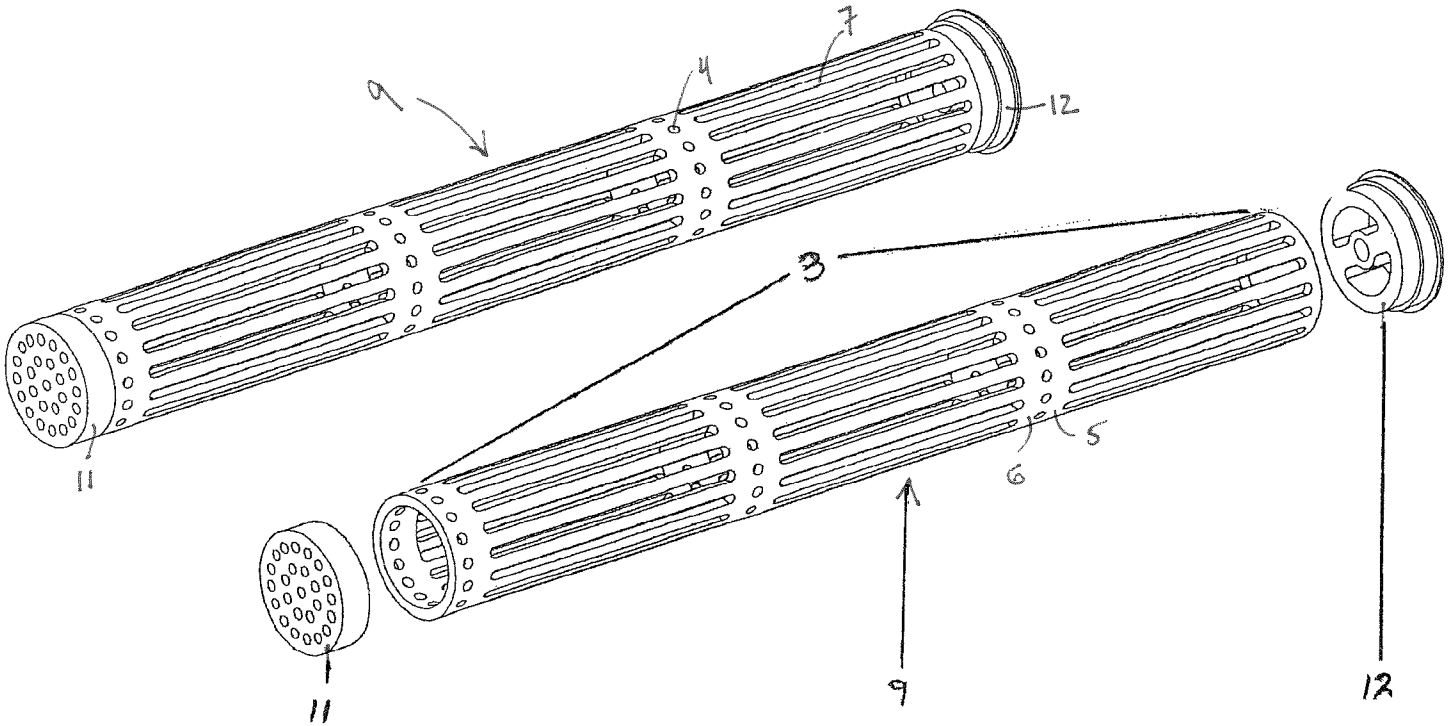
FIG. 5 is an exploded perspective view of an embodiment of the present invention.

Referring to the drawings wherein like reference characters designate like or corresponding parts throughout the several views, and referring particularly to FIG. 5, it is seen that this illustrated embodiment of the present invention includes an elongated cylindrical body 9 to which a lower end cap 11 and an upper end cap 12 are to be attached. Referring to FIG. 2, it is seen that the illustrated cylindrical body 9 includes at least one set of elongated slots 7 separated longitudinally along the length of cylindrical body 9 by at least one set of relief ports 4. The slots 7 of each set are provided in parallel to each other, and parallel to the central axis of the cylindrical body 9. The relief ports 4 of each set are provided longitudinally between each set of slots 7. In the illustrated embodiment, a set of relief ports is also provided at the bottom end of cylindrical body 9. Although the illustrated embodiments show three sets of slots 7 and three sets of ports 4, it is to be appreciated that more or fewer sets of slots and ports may be provided so long as a set of ports is provided between each set of slots. Similarly, although the illustrated embodiment depicts a set of relief ports at the bottom end of cylindrical body 9, another set of relief ports may also be provided at the upper opposite end of cylindrical body 9. Further, although the illustrated embodiment depicts sixteen slots in each set, and sixteen ports in each set, it is to be appreciated that different numbers of slots and/or ports may be provided in each set, and that the number of slots or ports in one set may not be the same as in another set.

It is to be appreciated that the size and number of slots 7 provided is usually in direct correlation to the length of the cylindrical body 9, depending upon the flow rates desired and the durability of the material of which body 9 is made. The slots 7 should generally be narrow in width to allow for effective filtering, but should also be long enough to adequately allow for fluids to continue moving down the drill string.

It is to be appreciated that the positioning of slots 7 defines a set of circumferential integrity bands 8 between each set of slots 7. Integrity bands 8 are bisected by ports 4, defining smaller bands 5, 6 on either side of ports 4 which provide strength to cylindrical body 9 along its length to prevent breakage, fatigue or other failure.

Figure 3:
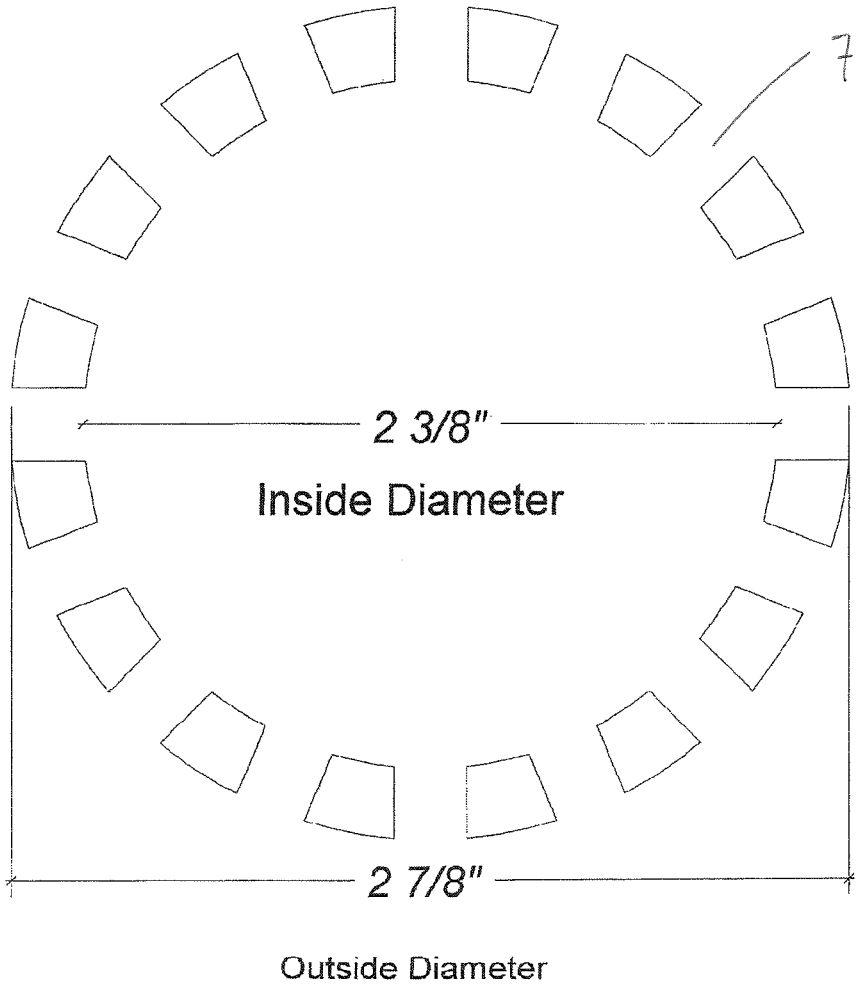
FIG. 3 is sectional view along line A-A of FIG. 2.

FIG. 3 is a sectional view along line A-A of FIG. 2, but also depicts an exemplary view along line B-B of FIG. 2 as well. In some embodiments of the invention, the openings of slots 7 and ports 4 are the same size on the inside and on the outside of body 9, with no tapering. However, in other embodiments, these openings may be tapered such that they are wider on the outside of cylindrical body 9 than on the inside of cylindrical body 9, and in other embodiments these openings may be tapered in an opposite direction such that they are wider on the inside of the cylindrical body 9 than on the outside of cylindrical body 9. It is to be appreciated that some or all of the slots and/or ports may be tapered from outside to inside, or from inside to outside, or not at all; and that each individual slot and/or port may have its own inside-out taper, or outside-in taper, or no taper at all. In some embodiments, the slots 7 and ports 4 may be cut or machined into an existing hollow tubular body 9; in other embodiments, the tubular body 9 may be cast in a mold with the slots 7 and ports 4 defined in the mold.

Figures 1, 1A:
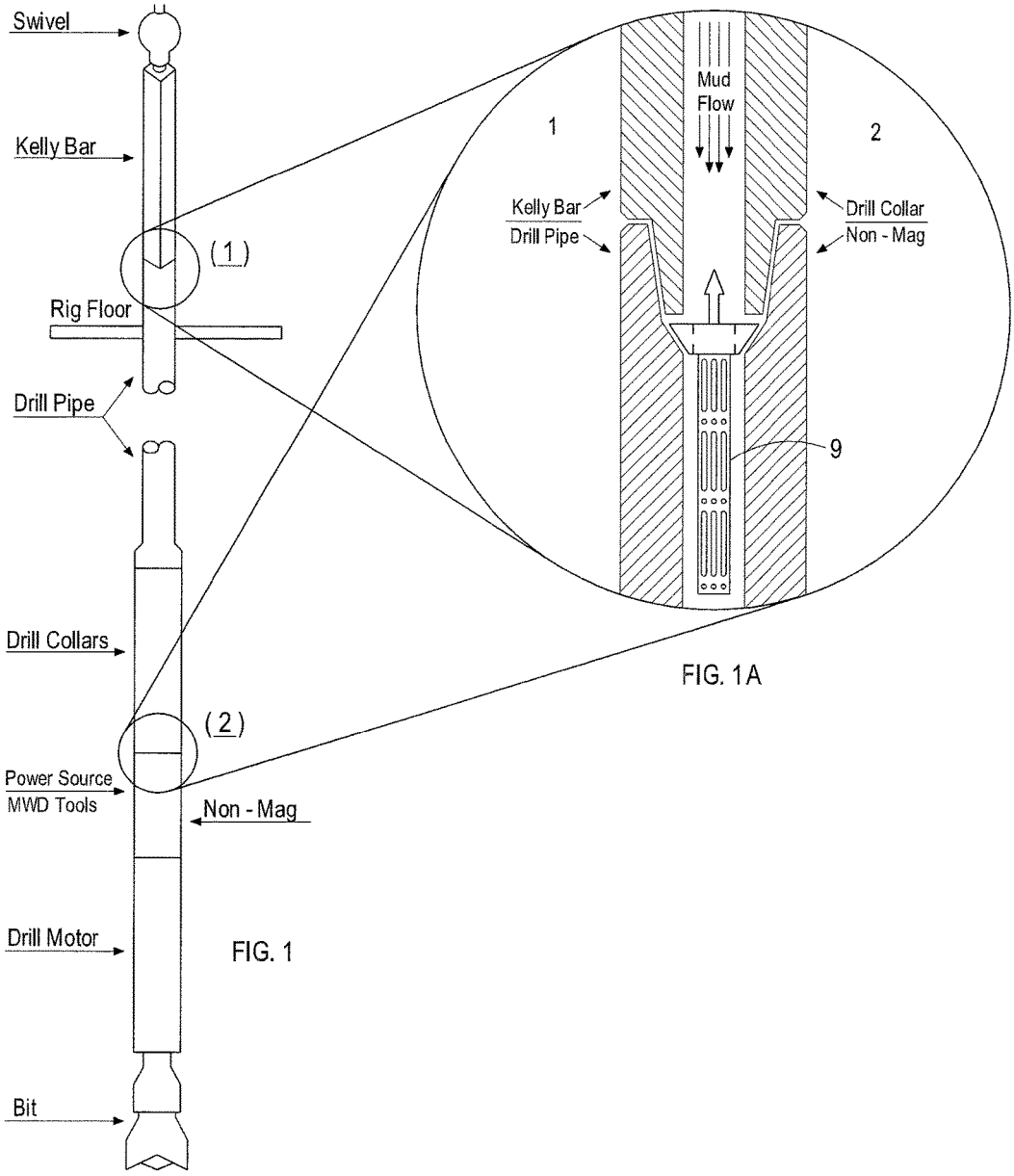
FIG. 1 is a schematic view of a typical drill string having a directional sensor powered by a turbine alternator that is operated using mud flowing through a drill screen.
FIG. 1A is an enlarged cut away view of a section of the drill string of FIG. 1 showing the placement of an embodiment of a filter of the present invention.

FIG. 1 depicts a typical MWD mud screen of the present invention in operation on a horizontal well. Connection (1) depicts one possible location for placement of a mud screen of the present invention, between a Kelly bar and the drill pipe for easy accessibility. Connection (2) depicts another possible location for placement of a mud screen of the present invention, between the drill collar and a non-magnetic pipe section for optimal filtering.

FIG. 2 illustrates an embodiment of a mud screen of the present invention after all manufacturing has been completed, and the end caps 11, 12 have been attached by welding or the like. Connection (3) depicts where the end caps are welded to the cylindrical body 9, which may be through Metal Inert Gas (MIG) or Tungsten Inert gas (TIG) welding applications, or other similar processes. Exemplary circular relief ports 4 are provided at the base of the illustrated cylindrical body 9 to allow high velocity drilling mud to drain while protecting vital weld points. Along the length of cylindrical body 9, between slots 7 and ports 4, circumferential integrity bands 8, bisected into bands 5 and 6 by ports 4 are provided to optimize strength and durability of the unit.

Without relief ports 4, circumferential bands 5 and 6 would form a single integrity band 8 in cylindrical body 9 having a sufficient length to withstand the increased pressure of the mud which can build up in these areas without breakage to body 9. Such an integrity band 8 may have a length of, for example and without limitation, approximately 1 and ¼ inch. However, as noted elsewhere herein, without the relief ports, once a lower section of slots becomes clogged with debris, a pressure spike would often be detected in the integrity band 8. Thus, a set of relief ports 4 are provided in embodiments of the present invention which divide such an integrity band 8 into two parts 5 and 6 in order to provide relief for flowing mud which avoids pressure spikes without loss of strength to body 9.

Figure 4:
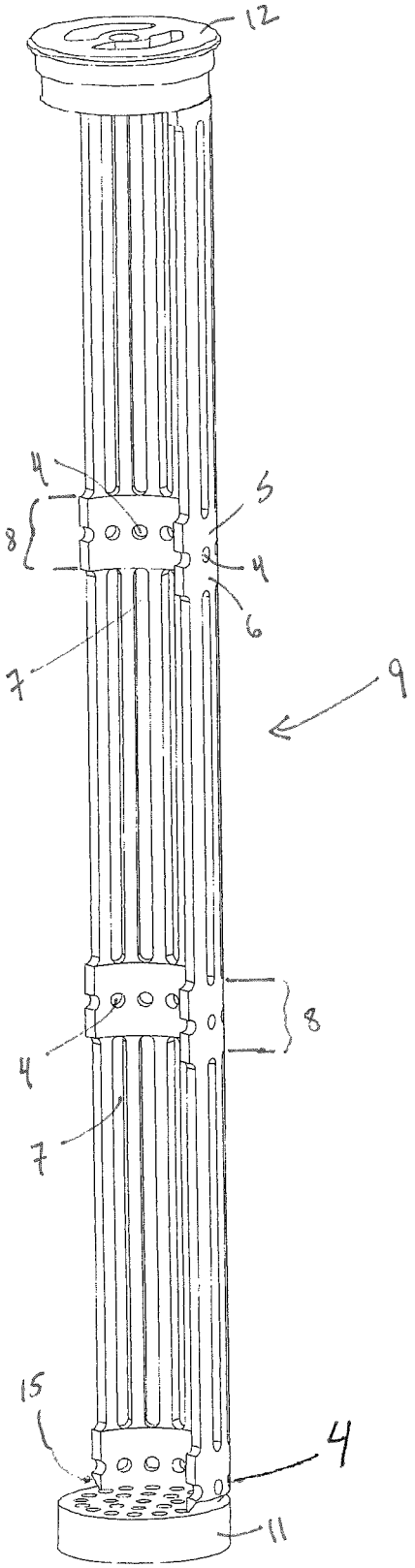
FIG. 4 is a partially cut away perspective view of an embodiment of the present invention.

FIG. 4 depicts a partially cut-away view of an embodiment of a mud screen of the present invention in which a lower end cap 11 has been attached using an exemplary weld bevel of 30 degrees 15 to allow for a full penetration weld. Such a weld bevel may be used to secure each end cap 11, 12 to the cylindrical body 9 in order to minimize internal erosion.

Figure 6:
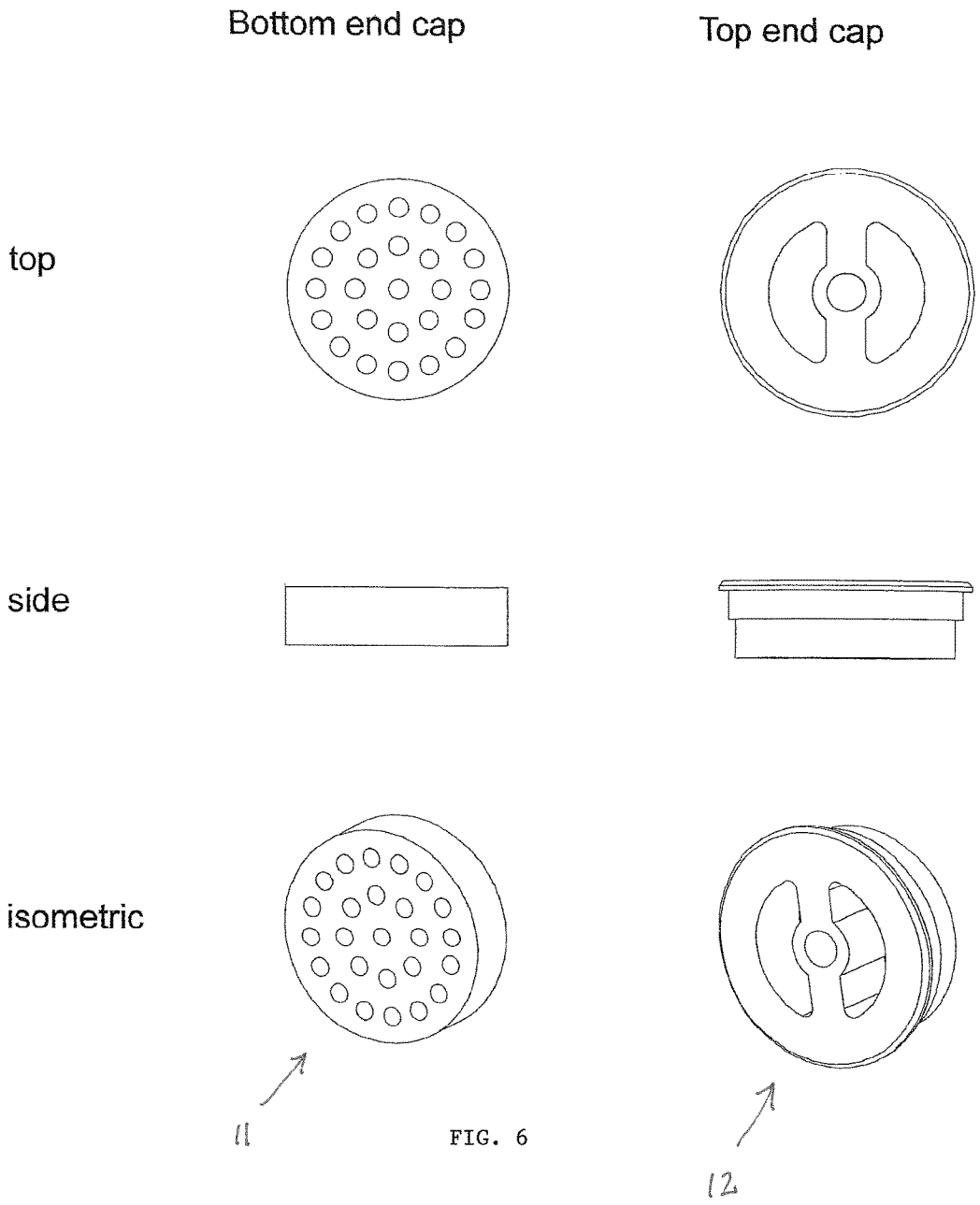
FIG. 6 shows top, side, and isometric views of embodiments of top and bottom end caps of the present invention.
Figure 7:
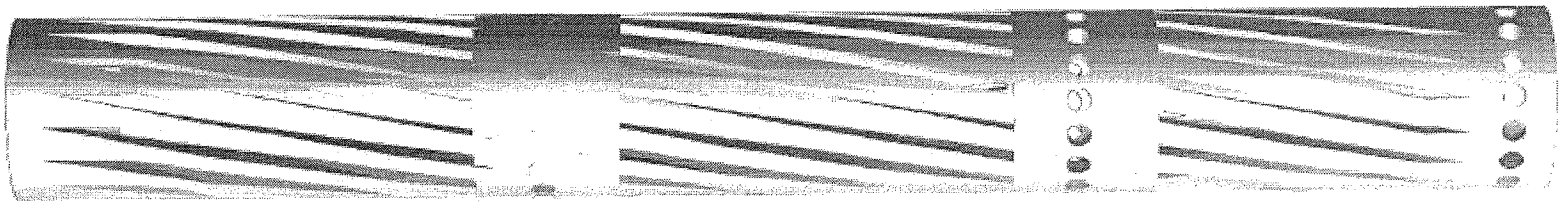
FIG. 7 is a side elevational view of an alternative embodiment of the present invention.
Figure 8:
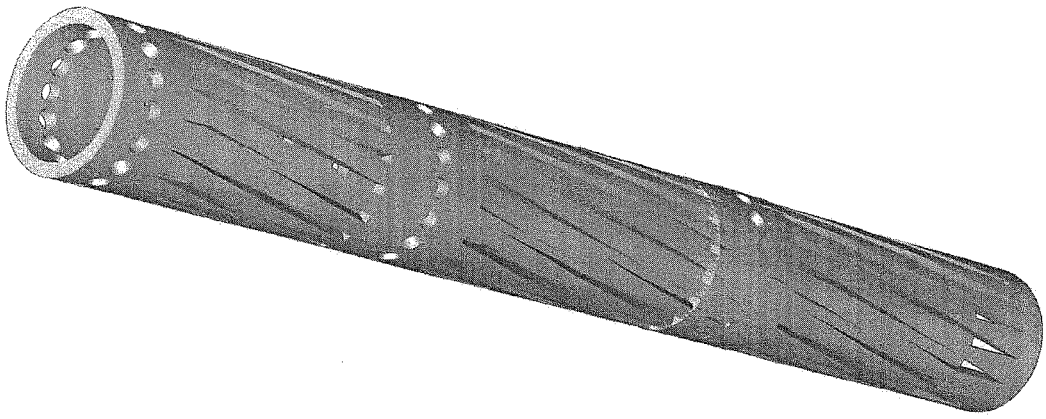
FIG. 8 is a perspective view of the embodiment of FIG. 7

FIG. 5 depicts an embodiment of the present invention before end caps 11, 12 are adhered to body 9, which may be through MIG or TIG welding applications. Top, side and isometric views of exemplary upper 12 and lower 11 end caps are shown in FIG. 6.

It is to be understood that variations and modifications of the present invention may be made without departing from the scope thereof. It is to be appreciated that the features disclosed herein may be used different combinations and permutations with each other, all falling within the scope of the present invention. It is also to be understood that the present invention is not to be limited by the specific embodiments disclosed herein, but only in accordance with the appended claims when read in light of the foregoing specification.

What is claimed is:

1. A drill pipe screen comprising a single unitary elongated tubular body having an inside, an outside, a cylindrical wall and a central axis, said cylindrical wall having at least one set of a plurality of elongated slots provided through said wall and along said body, said wall having at least one integrity band therein adjacent to said slots, and said wall also having at least one set of relief ports that are smaller than said slots provided through said wall on each such integrity band, wherein said elongated slots are provided in parallel to each other and in parallel to said central axis and are radially positioned and spaced apart from each other around the perimeter of said body, and said relief ports are radially positioned and spaced apart from each other around the perimeter of said body, wherein said slots define openings that are the same size on the inside and the outside of the cylindrical wall, and said relief ports also define openings that are the same size on the inside and the outside of said cylindrical wall.

* * * * *